US006725839B2

(12) United States Patent
Zdroik et al.

(10) Patent No.: US 6,725,839 B2
(45) Date of Patent: Apr. 27, 2004

(54) STAMPED METAL FUEL RAIL

(75) Inventors: Michael J. Zdroik, Metamora, MI (US); Jackson Roe, Goshen, IN (US)

(73) Assignee: Millennium Industries Corp., Cass City, MI (US)

( * ) Notice: Subject to any disclaimer, the term of this patent is extended or adjusted under 35 U.S.C. 154(b) by 0 days.

(21) Appl. No.: 10/157,425

(22) Filed: May 29, 2002

(65) Prior Publication Data

US 2003/0221672 A1 Dec. 4, 2003

(51) Int. Cl.[7] ..... F02M 55/02

(52) U.S. Cl. ..... 123/456; 138/30; 123/467; 123/468

(58) Field of Search ..... 123/467, 456, 123/468, 469, 470; 138/26–30

(56) References Cited

U.S. PATENT DOCUMENTS 4,649,884 A 3/1987 Tuckey
4,660,524 A * 4/1987 Bertsch et al. ..... 123/468
4,729,360 A * 3/1988 Fehrenbach et al. ..... 123/467
4,996,961 A * 3/1991 Usui ..... 123/456
5,505,181 A 4/1996 McRae et al.
5,845,621 A 12/1998 Robinson et al.
5,894,861 A 4/1999 Lorraine
5,896,843 A 4/1999 Lorraine
6,135,092 A 10/2000 Schaenzer et al.
6,205,979 B1 3/2001 Sims, Jr. et al.
6,354,273 B1 * 3/2002 Imura et al. ..... 123/467
6,371,083 B1 * 4/2002 Rossi et al. ..... 123/456
6,470,859 B2 * 10/2002 Imura et al. ..... 123/467
6,513,500 B2 * 2/2003 Braun et al. ..... 123/456

* cited by examiner

*Primary Examiner*—Thomas N. Moulis
(74) *Attorney, Agent, or Firm*—Dykema Gossett PLLC

(57) ABSTRACT

A fuel rail is provided which includes a housing formed by a first member with a first thickness. A bracket is provided, connected to the first member to connect the fuel rail to an internal combustion engine. A second stamped member is provided and is sealably connected to the first member to form a control volume therewith. The second member has a second thickness that is materially lower than the first thickness. Accordingly, the second member has a wall to damp pulsations caused by the opening and closing of the injectors fluidly connected with the rail.

15 Claims, 2 Drawing Sheets

STAMPED METAL FUEL RAIL

FIELD OF THE INVENTION

The field of the present invention is fuel rails for internal combustion engines and in particular, fuel rails for reciprocating piston, spark-ignited internal combustion engines.

BACKGROUND OF THE INVENTION

In the past three decades, there have been major technological efforts to increase the fuel efficiency of automotive vehicles. One technical trend to improve fuel efficiency has been to reduce the overall weight of the vehicle. A second trend to improve fuel efficiency has been to improve the aerodynamic design of a vehicle to lower its aerodynamic drag. Still another trend is to address the overall fuel efficiency of the engine.

Prior to 1970, the majority of production vehicles with a reciprocating piston gasoline engine had a carburetor fuel supply system in which gasoline is delivered via the engine throttle body and is therefore mixed with the incoming air. Accordingly, the amount of fuel delivered to any one cylinder is a function of the incoming air delivered to a given cylinder. Airflow into a cylinder is effected by many variables including the flow dynamics of the intake manifold and the flow dynamics of the exhaust system.

To increase fuel efficiency and to better control exhaust emissions, many vehicle manufacturers went to port fuel injection systems, where the carburetor was replaced by a fuel injector that injected the fuel into a port which typically served a plurality of cylinders. Although port fuel injection is an improvement over the prior carburetor fuel injection system, it is still desirable to further improve the control of fuel delivered to a given cylinder. In a step to further enhance fuel delivery, many spark ignited gasoline engines have gone to a system wherein there is supplied a fuel injector for each individual cylinder. The fuel injectors receive their fuel from a fuel rail, which is typically connected with all or half of the fuel injectors on one bank of an engine. Inline 4, 5 and 6 cylinder engines typically have one bank. V-block type 6, 8, 10 and 12 cylinder engines have two banks.

One critical aspect of a fuel rail application is the delivery of a precise amount of fuel at a precise pressure. In an actual application, the fuel is delivered to the rail from the fuel pump in the vehicle fuel tank. At an engine off condition, the pressure within the fuel rail is typically 45 to 60 psi. When the engine is started, a typical injector firing of 2–50 milligrams per pulse momentarily depletes the fuel locally in the fuel rail. Then the sudden closing of the injector creates a pressure pulse back into the fuel rail. The injectors will typically be open 1.5–20 milliseconds within a period of 10–100 milliseconds.

The opening and closing of the injectors creates pressure pulsations (typically 4–10 psi peak-to-peak) up and down the fuel rail, resulting in an undesirable condition where the pressure locally at a given injector may be higher or lower than the injector is ordinarily calibrated to. If the pressure adjacent to the injector within the fuel rail is outside a given calibrated range, then the fuel delivered upon the next opening of the injector may be higher or lower than that preferred. Pulsations are also undesirable in that they can cause noise generation. Pressure pulsations can be exaggerated in a returnless delivery system where there is a single feed into the fuel rail and the fuel rail has a closed end point.

To reduce undesired pulsations within the fuel rails, many fuel rails are provided with added pressure dampers. Dampers with elastomeric diaphragms can reduce peak-to-peak pulsations to approximately 1–3 psi. However, added pressure dampers are sometimes undesirable in that they add extra expense to the fuel rail and also provide additional leak paths in their connection with the fuel rail or leak paths due to the construction of the damper. This is especially true with new Environmental Protection Agency hydrocarbon permeation standards, which are difficult to satisfy with standard O-ring joints and materials. It is desirable to provide a fuel rail wherein pressure pulsations are reduced while minimizing the need for dampers.

Fuel rail systems have been developed which have reduced or eliminated the need for add on diaphragms or dampers. In one such fixed rail system, a compact fuel body is provided with a pulsating damping wall. The compact body is fluidly connected with various injector cups by flexible fuel tubes. This fuel rail system has been found to offer certain disadvantages.

The first disadvantage is that the damping wall is spaced away from the injector cup. Maximum damping efficiency occurs by having the damping wall as close as possible to the injector cup. The second disadvantage is the compact body with the flexible fuel tubes will typically include a type of high-temperature-resistant polymeric material that has a tendency to degrade in the high temperature environment adjacent to an engine. Additionally, brazing subsequent to fabrication often cannot be allowed since the temperature required for brazing will damage the flexible tubes. Accordingly, brazing of the compact body must be performed before connecting the flexible tubes to the compact body.

In an attempt to overcome the disadvantages associated with the compact fuel body with flexible fuel tubes there has come forth a fuel rail system having a generally thin wall rectangular tube which typically will have a height/width ratio of 1.5 to 2.0 or greater. The thin wall of the rectangular tube fuel rail system deflects upon pressure pulsations and acts as a damper. The thin wall rectangular tube design fuel rail system has some advantages over the compact body development in that the flexible fuel tubes may, in some instances, be eliminated. However, the rectangular thin wall tube design also brings forth certain disadvantages. The thinness of the flexible tube is limited by the structural rigidity that is required of the tube for its attachment to the engine. Additionally, the thin wall tube is hard to bend. Often a straight line is not a preferred configuration of the fuel rail due to other engine electrical and fluid conduits provided in the engine compartment. Another disadvantage of the prior invention is that the thinness of the thin wall rectangular tube can have excessive vibration or noise at certain frequencies of engine operation.

It is desirable to provide a fuel rail system that eliminates the requirement for add-on dampers which overcomes the noise problems associated therewith and prior vibration and noise. It is also desirable to provide a fuel rail system that can be brazed at late stages of assembly.

SUMMARY OF THE INVENTION

To make manifest the above-noted and other manifold desires, a revelation of the present invention is brought forth. In a preferred embodiment, the present invention provides a fuel rail for a plurality of fuel injectors. The fuel rail includes a sealed housing having a fuel inlet and at least two injector outlets. The sealed housing is formed by a first stamped male metallic member. The first member has a first thickness and at least first and second injector outlets delivering fuel to fuel injectors. Fixedly connected with the male member adjacent the injector outlets are injector cups. A bracket is provided which is fixedly connected to the first member (typically by welding) to connect the fuel rail to the internal combustion engine.

A second stamped female metallic member is provided and is sealably connected to the first member to form a control volume therewith. The second member has a second thickness that is materially lower than the first thickness of the first member. Accordingly, the second member has a wall to damp pulsations caused by the opening and closing of the injectors.

Further features and advantages of the present invention will become more apparent to those skilled in the art after a review of the invention as it shown in the accompanying drawings and detailed description.

DETAILED DESCRIPTION OF THE INVENTION

Figure 1:
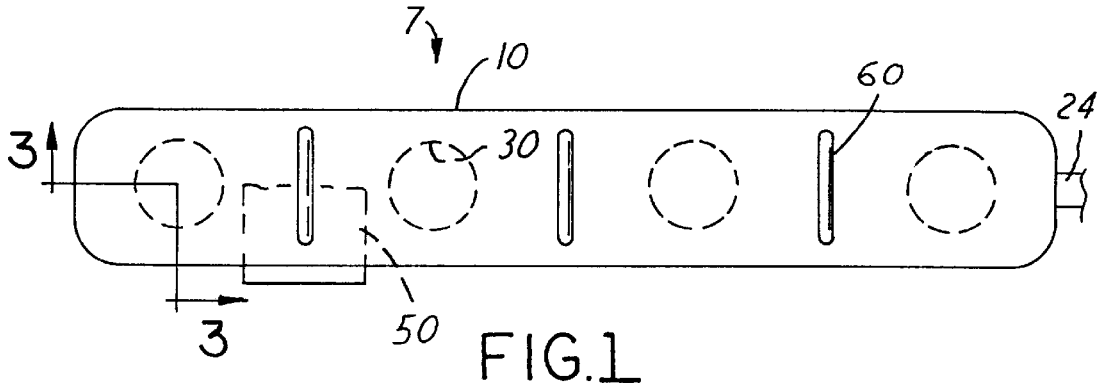
FIG. 1 is a top view of a preferred embodiment fuel rail according to the present invention.
Figure 2:
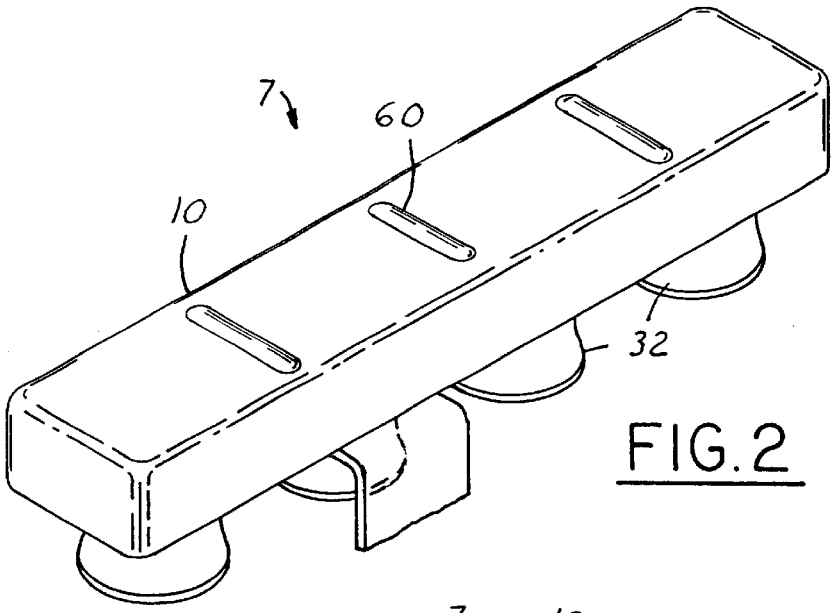
FIG. 2 is a perspective view of the fuel rail shown in FIG. 1.
Figure 3:
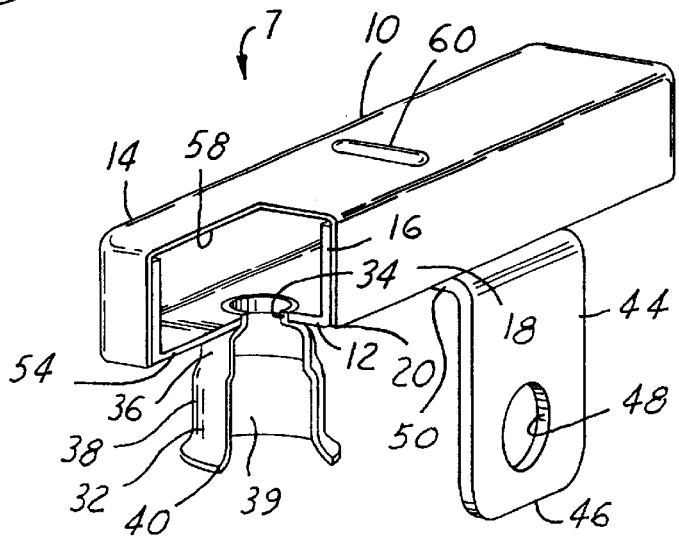
FIG. 3 is a view taken along lines 3—3 of FIG. 1.

Referring to FIGS. 1 through 4, the fuel rail 7 of the present invention provides fuel for a plurality of gasoline fuel injectors (not shown) for a reciprocating piston, spark-ignited internal combustion engine. The fuel rail 7 has a housing 10. The housing 10 has a first stamped male metallic member 12 and a second stamped female metallic member 14. The first member 12 is typically fabricated from low carbon or stainless steel sheet metal having a thickness of 0.030–0.045 inches for structural rigidity and dimensional control. The second stamped member 14 will be thinner, typically having a thickness of 0.010–0.030 inches. Member 12 is generally U-shaped having legs 16. Overlapping the legs 16 are legs 18 of the female member 14. A brazing bead 20 seals the male member and female member to each other providing the sealing for the housing 10. The sealed housing 10 also has an inlet 24. The inlet orifice is approximately 8 millimeters in diameter. The inlet 24 is encompassed by a pressure fitting which is fluidly connected with a pressurized fuel delivery line (not shown).

In the embodiment shown, the fuel rail 7 has three injector outlets 30. Brazed or otherwise fixably sealably attached to the injector outlets 30 are three injector cups 32. The injector cups 32 have a fitting portion 34 which extends through the injector outlets 30. The injector cups also have a generally flat annular portion 36 which is integrally joined to the fitting portion 34. The remainder of the injector cups 32 includes a cylindrical portion 38 having a lower flared rim 40.

The fuel rail 7 has a bracket 44. The bracket 44 is L-shaped having a leg 46 with a fastener aperture 48. The bracket also has a leg 50 which is adhesively, weldably or brazenly attached to a base 54 of the male member 12.

A base 58 of the female member 14 along various locations has stamped therein ribs 60. The ribs provide stiffening to the base 58.

In operation, fuel is delivered to the housing 10 via the inlet 24. A shown, the fuel rail 7 is a non-recirculating type of fuel rail. Therefore all fuel which enters through inlet 24 is eventually expended through one of the outlet cups 32. The fuel typically is gasoline but the present invention can work with other fuels such as ethyl alcohol, blends of gasoline and ethyl alcohol and other typical automotive fuels.

Pulsations caused by the opening and closing of the fuel injectors are primarily damped by the base 58 of the female member 14. The base 58 with its thin metal, flexes with the pulsations and effectively damps the same.

A particular feature that makes the present invention effective, is that base 58 is far thinner than the combined thicknesses of the legs 16, 18 of the male and female members 12, 14. The base 58 is also thinner than the base 54 of the male member 12. Therefore, any tendency of flexure will occur almost totally along the base 58 of the female member. Meanwhile, the critical dimensional tolerances of the injector seal 39 to bracket the fastener aperture 48 will be maintained by the thicker material.

The stiffening ribs 60 allow flexing above the injectors and break up any resonances created along the length of the rail. The ribs bifurcate the female member base 58 between the injector outlets 30 along the base 54 of the male member 12. As shown, typically, the fuel rail 7 will have a resonance greater than 1000 hz, keeping it well out of the acoustic range wherein it can generate noise, which is typically not appreciated by the vehicle operator.

Figure 4:
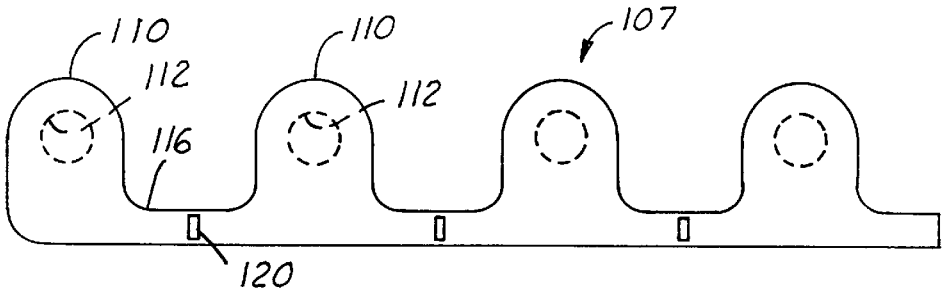
FIG. 4 is a top view of an alternate preferred embodiment of the present invention.

Referring to FIG. 4 an alternate preferred embodiment fuel rail according to the present invention is provided. The fuel rail 107 has male and female member with legs essentially similar or identical to those previously described. The fuel rail 107 has enlarged first portions 110 which are adjacent to fuel injector outlets 112. Separating the enlarged portions 110 from one another are generally narrow second portions 116. The ratio of thickness between the first and second portions will typically be 1.5 or more. The fuel rail 107 also has stiffening ribs 120. This geometry allows the greatest movement in direct proximity to the injector, allowing damping to occur locally.

Figure 5:
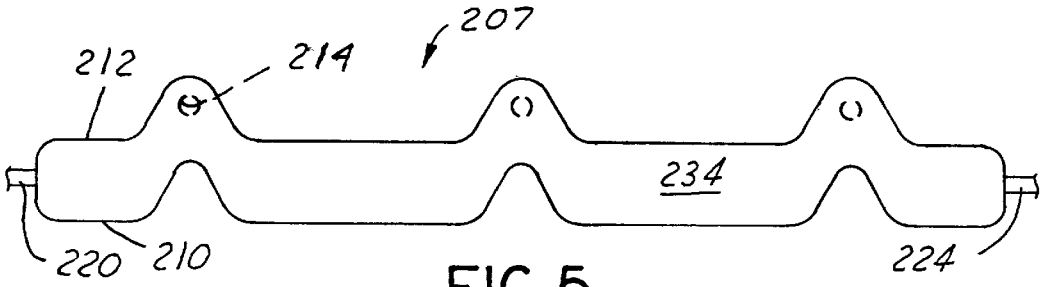
FIG. 5 is a top view of yet another alternate preferred embodiment fuel rail according to the present invention.

Referring to FIG. 5, an alternate preferred embodiment fuel rail 207 is provided. In the fuel rail 207, the lateral thickness between the sides 210, 212 essentially remains equal even though the sides have a serpentine shape adjacent to the injector outlets 214. The fuel rail 207 is a continuous fuel rail having an inlet 220 and an outlet 224 which is connected with another fuel rail for an opposite bank of an engine (not shown). The stamped female member has a base surface 234.

Figure 6:
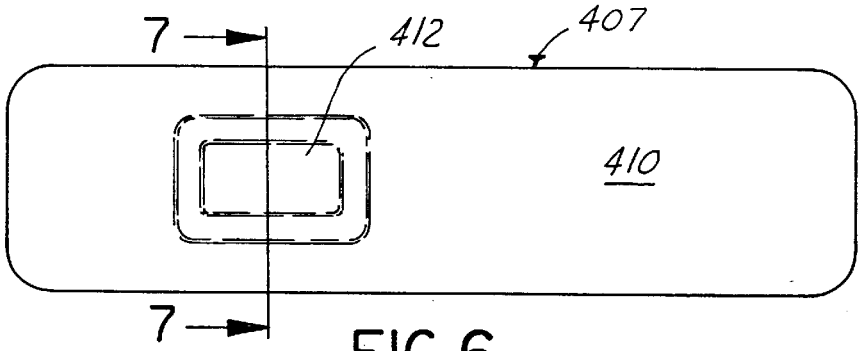
FIG. 6 is a top view of yet another alternate preferred embodiment fuel rail according to the present invention.
Figure 7:
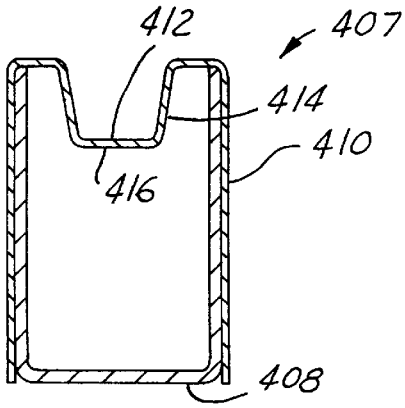
FIG. 7 is a view taken along lines 7—7 of FIG. 6.

Referring to FIGS. 6–7, an alternate embodiment fuel rail 407 has a male member 408 and a thin wall female member 410. The female member has an inward extending valley 412 with sidewalls 414, which act as stiffeners and the base 416 of the valley provides a defined diaphragm. The fuel rail 407 may have multiple defined diaphragms 416 if so desired. In many instances, the length of the defined diaphragms 416 will be a multiple of the width.

While preferred embodiments of the present invention have been disclosed, it is to be understood that they have been disclosed by way of example only and that various modifications can be made without departing from the spirit and scope of the invention as it is explained by the following claims.

We claim:

1. A fuel rail for delivering fuel to a plurality of fuel injectors for a reciprocating piston internal combustion engine, comprising:

a sealed housing including a first stamped metallic member having a first thickness, said first member having at least first and second injector outlets for delivering fuel to said fuel injectors;

injector cups fixably connected with said first member adjacent said injector outlets; and a second stamped metallic member sealably connected to said first member forming a control volume therewith, said second member having a second thickness materially thinner than said first thickness to damp pulsations caused by opening and closing of fuel injectors connected to said injector cups, said second member having stiffening ribs formed therein.

2. A fuel rail as described in claim 1, wherein said first member is a male stamping and said second member is a female stamping which receives said male stamping.

3. A fuel rail as described in claim 1, wherein said first thickness is in a range of 0.030 to 0.045 inches and said second thickness is in a range of between 0.010 to 0.030 inches.

4. A fuel rail as described in claim 1, wherein said fuel rail resonates over 1000 hz when said fuel rail is being utilized on an internal combustion engine.

5. A fuel rail as described in claim 1, wherein said first member has fixably connected thereto a bracket for connecting said fuel rail to an internal combustion engine.

6. A fuel rail as described in claim 1, wherein said fuel rail has a first lateral width between said injector outlets and said fuel rail has a second lateral width adjacent to said injector outlets and a ratio of said first lateral width to said second lateral width is approximately 1:3 or greater.

7. A fuel rail as described in claim 1, wherein said ribs are formed between said injector outlets.

8. A fuel rail as described in claim 1, wherein said fuel rail has an outlet to facilitate said housing supplying fuel to another fuel rail.

9. A fuel rail as described by claim 2, wherein said male and female members have legs and wherein a majority of said legs of said male members is overlapped by said legs of said female members.

10. A fuel rail as described in claim 1, wherein said fuel rail has a generally constant lateral width and has a serpentine shape adjacent injector outlets.

11. A fuel rail as described in claim 1 wherein said second member has an extended valley with a defined diaphragm.

12. A fuel rail for delivering fuel to a plurality of fuel injectors for a reciprocating piston internal combustion engine comprising:

a sealed housing having an inlet for receiving fuel, said housing including:

a first stamped male metallic member having a first thickness between 0.030 and 0.045 inches, said first member having at least first and second injector outlets for delivering fuel to said fuel injectors;

injector cups fixably connected with said first member adjacent said injector outlets;

a bracket fixably connected to said first member for connecting said fuel rail to said internal combustion engine; and a second stamped female metallic member sealably connected to said first member with legs overlapping legs of said first member, and forming a control volume therewith, said second stamped member having a second thickness materially lower than said first thickness between 0.010 and 0.030 inches to damp pulsations caused by opening and closing of said injectors, said second member having stiffening ribs formed therein.

13. A fuel rail for delivering fuel to a plurality of fuel injectors for a reciprocating piston internal combustion engine comprising:

a sealed housing having a first stamped metallic member having a first thickness, said first member having at least first and second injector outlets for delivering fuel to said fuel injectors;

injector cups fixably connected with said first member adjacent said injector outlets; and a second stamped metallic member sealably connected to said first member forming a control volume therewith, said second member having a second thickness materially thinner than said first thickness to damp pulsations caused by opening and closing of fuel injectors connected to said injector cups and wherein said fuel rail has a first lateral width between said injector outlet and said fuel rail has a second lateral width adjacent to said injector outlets and a ratio of said first lateral width to said second lateral width is approximately 1:3 or greater.

14. A fuel rail as described in claim 13, wherein said second member has stiffening ribs formed therein.

15. A fuel rail for delivering fuel to a plurality of fuel injectors for a reciprocating piston internal combustion engine, comprising:

a sealed housing including a first stamped metallic member having a first thickness, said first member having at least first and second injector outlets for delivering fuel to said fuel injectors;

injector cups fixably connected with said first member adjacent said injector outlets; and a second stamped metallic member sealably connected to said first member forming a control volume therewith, said second member having a second thickness materially thinner than said first thickness to damp pulsations caused by opening and closing of fuel injectors connected to said injector cups and wherein said second member has a first surface with inward extending stiffening sidewalls forming a valley, said sidewalls bordering a generally planar base defining a diaphram.

* * * * *